US007174701B2

(12) United States Patent
Horn

(10) Patent No.: US 7,174,701 B2
(45) Date of Patent: Feb. 13, 2007

(54) ELECTRICAL RESISTANCE HEATER HAVING A CORE MATERIAL BACK TWIST VERIFICATION WITH TRACER

(75) Inventor: James A. Horn, Winona Lake, IN (US)

(73) Assignee: Dekko Technologies, Inc., North Webster, IN (US)

( * ) Notice: Subject to any disclaimer, the term of this patent is extended or adjusted under 35 U.S.C. 154(b) by 149 days.

(21) Appl. No.: 10/989,913

(22) Filed: Nov. 16, 2004

(65) Prior Publication Data

US 2006/0102619 A1 May 18, 2006

(51) Int. Cl.
*D02G 3/22* (2006.01)

(52) U.S. Cl. ..... 57/12; 57/210

(58) Field of Classification Search ..... 57/12
See application file for complete search history.

(56) References Cited

U.S. PATENT DOCUMENTS

| | | | | |
|---|---|---|---|---|
| 3,668,302 | A | 6/1972 | Boland et al. | 174/121 |
| 4,714,642 | A | 12/1987 | McAliley et al. | 428/113 |
| 4,789,045 | A | 12/1988 | Pugh | 182/190 |
| 4,804,806 | A | 2/1989 | Orr, Jr. et al. | 174/117 |
| 5,380,954 | A | 1/1995 | Orr, Jr. | 174/117 |
| 5,557,915 | A | 9/1996 | Knoff et al. | 57/204 |
| 5,979,287 | A | 11/1999 | Starbile | 87/1 |
| 6,341,550 | B1 | 1/2002 | White | 87/5 |
| 2004/0068972 | A1* | 4/2004 | Kanno et al. | 57/210 |

* cited by examiner

*Primary Examiner*—Shaun R. Hurley
(74) *Attorney, Agent, or Firm*—Taylor & Aust, P.C.

(57) ABSTRACT

A method of manufacturing a conductor assembly including the steps of winding and back twisting. The winding step includes winding an electrical conductor around a core material, the core material including at least one color differentiated portion, the core material having a longitudinal axis. The back twisting step includes back twisting the core material until the at least on color differentiated portion is in substantial alignment with the longitudinal axis.

14 Claims, 2 Drawing Sheets

ELECTRICAL RESISTANCE HEATER HAVING A CORE MATERIAL BACK TWIST VERIFICATION WITH TRACER

BACKGROUND OF THE INVENTION

1. Field of the Invention

The present invention relates to an assembly and a method of assembling an electrical heater assembly, and, more particularly, to an electrical resistance heater assembly with a core material.

2. Description of the Related Art

Electrical conductors are utilized to transfer electrical energy from one place to another. Electrical conductors that have a resistive component are utilized to deliver heat to the environment in which they are thermally coupled. The direct conversion of electrical energy into heat was first described by the English physicist James P. Joule. According to Joule's Law, a conductor carrying a current generates heat at a rate proportional to the product of the resistance of the conductor and the square of the current. It is the use of this principal, of applying electrical energy to a distributed resistance, which has resulted in various geometries of electrical conductors for the production of warmth or the application of heat to a specific environment.

It is known to spirally wrap a conductive element around an electrically non-conductive element in order to support the conductive element. Further a spirally wrapped conductive element allows a thinner wire to be utilized thereby increasing the resistance of the wire and by spirally wrapping a wire increasing the amount of heat generated in a specific volume. The application of a conductive wire to a core material results in an assembly that has a natural curl. This curl imparts a tendency of the assembly to not lay flat, which is caused by the assembly technique of wrapping a wire about the core material.

What is needed in the art is a method of assembling a conductor to a core material to alleviate the tendency for the assembly to curl.

SUMMARY OF THE INVENTION

The present invention provides a method of assembling a conductor assembly and removing the twist of the core material.

The invention comprises, in one form thereof, a method of manufacturing a conductor assembly including the steps of winding and back twisting. The winding step includes winding an electrical conductor around a core material, the core material including at least one color differentiated portion, the core material having a longitudinal axis. The back twisting step includes back twisting the core material until the at least on color differentiated portion is in substantial alignment with the longitudinal axis.

An advantage of the present invention is that the heating conductor assembly has a tendency to lay flat rather than being curled.

Another advantage of the present invention is that a visual tracer is introduced allowing the back twist to be verifiably removed from the core material.

A further advantage is that the connector assembly is easily manufactured by helically winding a conductor around a non-conductive core and then back twisting the core.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
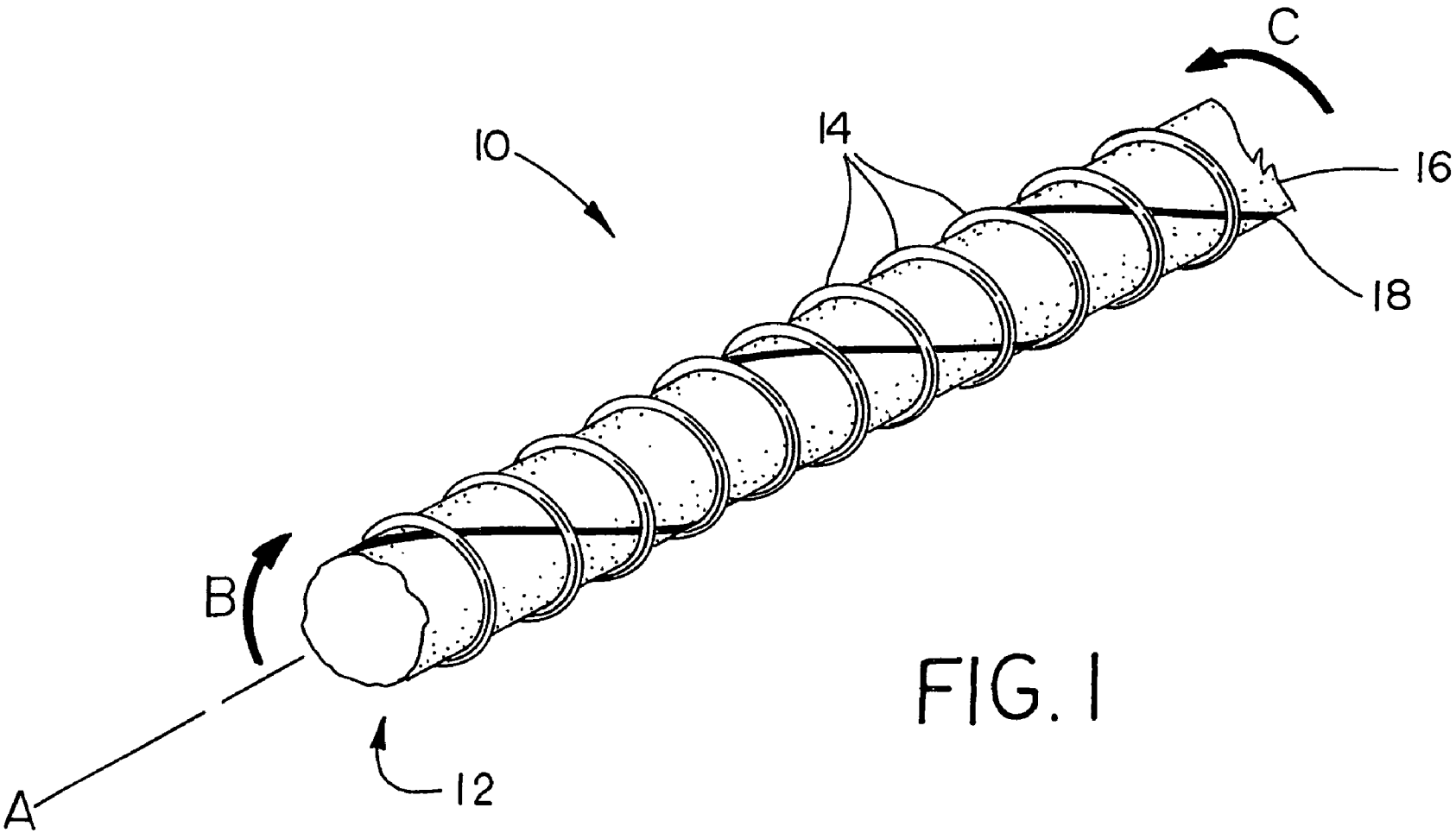
FIG. 1 is a perspective view of one embodiment of a heating conductor assembly of the present invention.

Referring now to the drawings, and more particularly to FIG. 1, there is shown a conductor assembly 10 having a core material 12 with conductor 14 spirally wound thereabout. Core material 12 includes fibers 16 and a color differentiated fiber 18. Core material 12 may be a uniform material having a color differentiated portion 18 applied thereto. Alternatively, core material 12 may be a series of fibers 16 having at least one color differentiated fiber 18.

As conductor assembly 10 is manufactured, conductor 14 is helically wound around core material 12 causing a compression of core material 12 and a twist is introduced to core material 12 by the winding action of conductor 14 thereon. This twist is an unwelcome result of whining conductor 14 onto core 12. Prior to conductor 14 being applied to core material 12, color differentiated portion 18, also known as a tracer 18 is substantially parallel to axis A of core material 12. However, the winding action of the machine applying conductor 14 to core material 12 causes a twist to occur in core material 12 as illustrated in FIG. 1 in which tracer 18 indicates that core material 12 has been biased in a helical fashion. This causes assembly 10 to have a tendency to curl and not lay flat since core material 12 now has a twist introduced to it by the assembly operation.

Although not shown, conductor assembly 10 may have at least on additional electrical insulating, thermal conducting, coating placed thereover. Additionally, although only one tracer 18 is illustrated more than one tracer 18 may be incorporated into core material 12.

Figure 2:
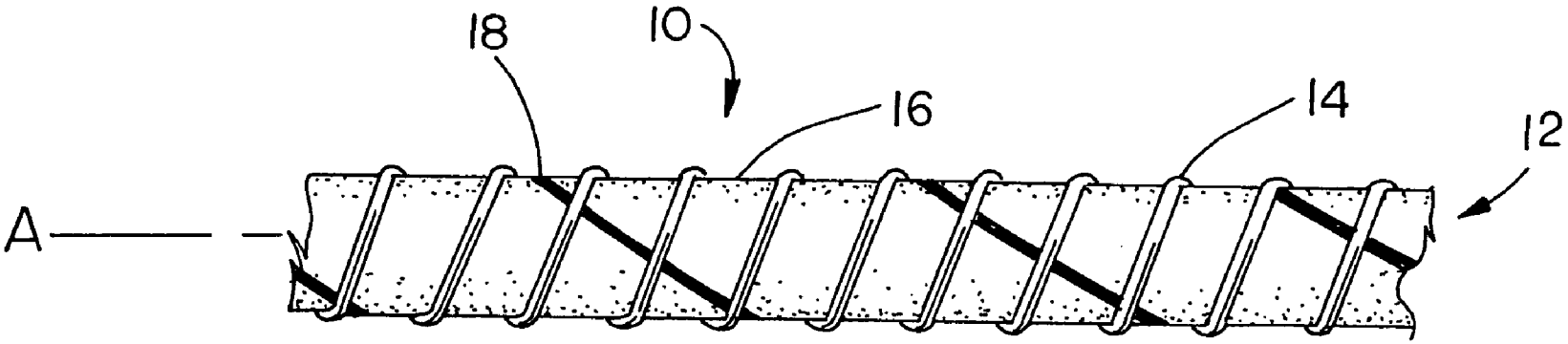
FIG. 2 is a side view of the conductor assembly of FIG. 1.
Figure 3:
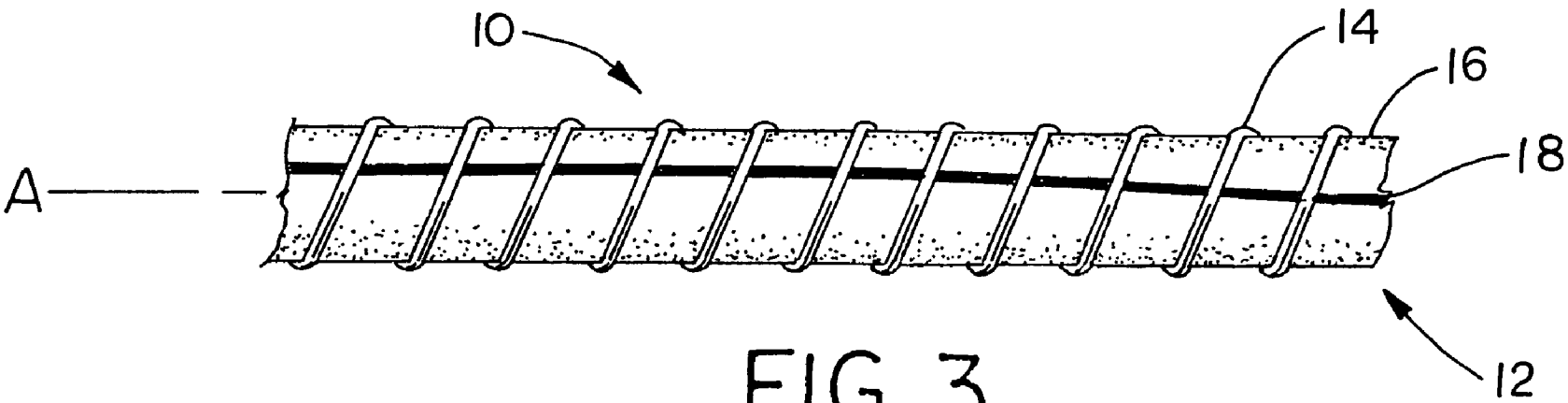
FIG. 3 is a side view of the conductor assembly of FIGS. 1 and 2 with the method of the present invention having been applied thereto.

Now, additionally referring to FIGS. 2 and 3, there are shown conductor assemblies 10, with FIG. 2 illustrating a twisted core material 12. Once conductor 14 is applied to core material 12 the twist of core material 12 is indicated by the helical nature of tracer 18, then a back twist is applied to core material 12 to remove the twist of core material 12. A rotational force is applied, as is illustrated in FIG. 1 in which core material 12 is twisted in directions B and C so that tracer 18 becomes substantially parallel to axis A as shown in FIG. 3. Back twisting of core material 12 results in removing a built-in tension in core material 12 causing assembly 10 to curl. Advantageously, assembly 10, once back twisted as shown in FIG. 3, will lay flat without a tendency for assembly 10 to curl.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of manufacturing a conductor assembly, comprising the steps of:

winding an electrical conductor around a core material, said core material including at least one color differentiated portion, said core material having a longitudinal axis; and back twisting at least some said core material until said at least one color differentiated portion is in substantial alignment with said longitudinal axis.

2. The method of claim 1, wherein said winding step results in a spiral winding of said electrical conductor around said core material.

3. The method of claim 1, wherein said core material includes a plurality of strands including at least one strand being said color differentiated portion.

4. The method of claim 3, wherein said color differentiated portion is a colored fiber.

5. The method of claim 1, wherein said back twisting step is a rotation of said core material over at least a portion of the length of the conductor assembly.

6. A conductor assembly, comprising:

a core material having a longitudinal axis and a color differentiated portion substantially parallel with said longitudinal axis; and an electrical conductor spirally wound around said core material, thereby altering said parallel relationship of said color differentiated portion with said longitudinal axis, said parallel relationship being substantially restored by back twisting at least some said core material.

7. The assembly of claim 6, wherein said core material includes a plurality of strands including at least one strand being said color differentiated portion.

8. The assembly of claim 6, wherein said color differentiated portion is a colored fiber.

9. The assembly of claim 6, wherein said back twisting is a rotation of said core material over at least a portion of the length of the conductor assembly.

10. A method of manufacturing a conductor assembly, comprising the steps of:

providing a core material having a longitudinal axis, said core material having a color differentiated portion substantially parallel with said longitudinal axis;

winding an electrical conductor about said core material, thereby causing said color differentiated portion to not be in substantially parallel alignment with said longitudinal axis; and back twisting at least some said core material until said color differentiated portion is again substantially parallel with said longitudinal axis.

11. The method of claim 10, wherein said winding step results in a spiral winding of said electrical conductor around said core material.

12. The method of claim 10, wherein said core material includes a plurality of strands including at least one strand being said color differentiated portion.

13. The method of claim 10, wherein said color differentiated portion is a colored fiber.

14. The method of claim 10, wherein said back twisting step is a rotation of said core material over at least a portion of the length of the conductor assembly.

* * * * *